US007807610B2

(12) United States Patent
Harris et al.

(10) Patent No.: US 7,807,610 B2
(45) Date of Patent: Oct. 5, 2010

(54) LUBRICATING OIL COMPOSITIONS

(75) Inventors: Steve Harris, Oxford (GB); Peter Anthony Tasker, Edinburgh (GB)

(73) Assignee: Infineum International Limited, Oxfordshire (GB)

( * ) Notice: Subject to any disclaimer, the term of this patent is extended or adjusted under 35 U.S.C. 154(b) by 165 days.

(21) Appl. No.: 11/942,124

(22) Filed: Nov. 19, 2007

(65) Prior Publication Data

US 2009/0131292 A1 May 21, 2009

(51) Int. Cl.
*C10M 129/76* (2006.01)
*C10M 131/00* (2006.01)
*C10M 169/04* (2006.01)

(52) U.S. Cl. ..... 508/501; 508/502; 508/503

(58) Field of Classification Search ..... 508/501, 508/502, 503

See application file for complete search history.

(56) References Cited

U.S. PATENT DOCUMENTS 4,770,799 A * 9/1988 Farng et al. ..... 508/478

6,043,199 A * 3/2000 Godici ..... 508/285

* cited by examiner

*Primary Examiner*—Walter D Griffin
*Assistant Examiner*—Frank C Campanell

(57) ABSTRACT

An automotive lubricating oil composition containing:

(A) an oil of lubricating viscosity in a major amount; and (B) as an additive component in a minor amount, an oil-soluble or oil-dispersible 4-oxobutanoic acid having the moiety —$CO(CH_2)COOH$ bonded to (i) a group $OR^1$ where $R^1$ is hydrocarbyl group having 10 to 30 carbon atoms; or (ii) a group X being an aromatic group substituted with at least one hydrocarbyl group having 10 to 30 carbon atoms; or (iii) a group $NR^2R^3$ where one or both of $R^2$ and $R^3$ is hydrocarbyl group having from 10 to 30 carbon atoms and one but not both of $R^2$ and $R^3$ may be a hydrogen atom, or a salt thereof.

13 Claims, No Drawings

LUBRICATING OIL COMPOSITIONS

FIELD OF THE INVENTION

This invention relates to automotive lubricating oil compositions, more especially to compositions suitable for use in piston engine, especially gasoline (spark-ignited) and diesel (compression-ignited), crankcase lubrication, such compositions being referred to as crankcase lubricants; and to use of additives in friction modification. The invention concerns use of friction modifiers in automotive lubrication.

BACKGROUND OF THE INVENTION

A crankcase lubricant is an oil used for general lubrication in an engine where there is an oil sump below the crankshaft of the engine and to which circulated oil returns. It is well known to include additives in crankcase lubricants for several purposes. Friction modifiers, also referred to as friction-reducing agents, may be boundary additives that operate by lowering friction coefficient and hence improve fuel economy; the use of glycerol monoesters as friction modifiers has been described in the art, for example in U.S. Pat. No. 4,495,088; U.S. Pat. No. 4,683,069; EP-A-0 092 946; and WO-A-01/72933. Glycerol monoester friction modifiers have been and are used commercially.

GB-A-2 106 106 describes reducing fuel consumption in an internal combustion engine by lubricating the engine during operation with a lubricating composition comprising a minor amount of at least one ester having the formula $R^1(COOR^4)_m$ wherein:

$R^1$ is an aliphatic hydrocarbon-based radical free from acetylenic unsaturation and containing from about 10 to about 35 carbon atoms, in which at least 8 carbon atoms are in a straight-chain configuration;

each $R^4$ is independently hydrogen or an alkyl or alkenyl radical containing up to about 18 carbon atoms, at least one $R^4$ being alkyl or alkenyl; and m is an integer from 2 to 5.

Formulators of lubricants are always seeking further ways of reducing the amount of fuel consumed in operation of internal combustion engines.

SUMMARY OF THE INVENTION

This invention provides, surprisingly, as evidenced by the data in this specification, an improvement in friction modification over glycerol ester additives by employing butanoic acids or salts thereof.

In a first aspect, the invention comprises an automotive lubricating oil composition comprising or made by admixing:

(A) an oil of lubricating viscosity in a major amount; and (B) as an oil-soluble or oil-dispersible additive component in a minor amount, a 4-oxobutanoic acid, having the moiety —CO $(CH_2)_2COOH$ bonded to (i) a group $OR^1$, where $R^1$ is hydrocarbyl group having from 10 to 30 carbon atoms, to provide a half-acid half-ester; or (ii) a group X, where X an aromatic group substituted with at least one hydrocarbyl group having from 10 to 30 carbon atoms to provide a keto-acid; or (iii) a group $NR^2R^3$ where one or both of $R^2$ and $R^3$ is hydrocarbyl group having from 10 to 30 carbon atoms and one but not both of $R^2$ and $R^3$ may be a hydrogen atom to provide a half acid-half amide, or a salt thereof.

In a second aspect, this invention provides a method for lubricating an internal combustion engine comprising (a) supplying the crankcase thereof with a composition according to the first aspect of the invention, and (b) operating the engine.

In a third aspect, this invention provides the use of an oil-soluble or oil-dispersible 4-oxobutanoic acid or salt thereof as defined in the first aspect of the invention as an additive component in a lubricating oil composition to enhance, in the lubrication of an internal combustion engine, the friction-modifying properties of the lubricating oil composition.

In this specification, the following words and expressions, if used, have the meanings ascribed below:

"active ingredients" or "(a.i.)" refers to additive material that is not diluent or solvent;

"comprising" or any cognate word specifies the presence of stated features, steps, or integers or components, but does not preclude the presence or addition of one or more other features, steps, integers, components or groups thereof. The expressions "consists of" or "consists essentially of" or cognates may be embraced within "comprises" or cognates, wherein "consists essentially of" permits inclusion of substances not materially affecting the characteristics of the composition to which it applies;

"hydrocarbyl" means a chemical group of a compound that contains hydrogen and carbon atoms and that is bonded to the remainder of the compound directly via a carbon atom. The group may contain one or more atoms other than carbon and hydrogen ("hetero atoms") provided they do not affect the essentially hydrocarbyl nature of the group;

"major amount" means in excess of 50 mass % of a composition;

"minor amount" means less than 50 mass % of a composition.

Also, it will be understood that various components used, essential as well as optimal and customary, may react under conditions of formulation, storage or use and that the invention also provides the product obtainable or obtained as a result of any such reaction.

Further, it is to be understood that any upper and lower quantity, range and ratio limits set forth herein may be independently combined.

DETAILED DESCRIPTION OF THE INVENTION

The features of the invention relating, where appropriate, to each and all aspects of the invention, will now be described in more detail as follows:

Oil of Lubricating Viscosity (A)

The oil of lubricating viscosity (sometimes referred to as "base stock" or "base oil") is the primary liquid constituent of a lubricant, into which additives and possible other oils are blended, for example to produce a final lubricant (or lubricant composition).

A base oil is useful for making concentrates as well as for making lubricating oil compositions therefrom, and may be selected from natural (vegetable, animal or mineral) and synthetic lubricating oils and mixtures thereof. It may range in viscosity from light distillate mineral oils to heavy lubricating oils such as gas engine oil, mineral lubricating oil, motor vehicle oil and heavy duty diesel oil. Generally the viscosity of the oil ranges from 2 to 30, especially 5 to 20, $mm^2s^{-1}$ at 100° C.

Natural oils include animal and vegetable oils (e.g. castor and lard oil), liquid petroleum oils and hydrorefined, solvent-treated mineral lubricating oils of the paraffinic, naphthenic and mixed paraffinic-naphthenic types. Oils of lubricating viscosity derived from coal or shale are also useful base oils.

Synthetic lubricating oils include hydrocarbon oils such as polymerized and interpolymerized olefins (e.g. polybutylenes, polypropylenes, propylene-isobutylene copolymers, chlorinated polybutylenes, poly(1-hexenes), poly(1-octenes), poly(1-decenes)); alkylbenzenes (e.g. dodecylbenzenes, tetradecylbenzenes, dinonylbenzenes, di(2-ethylhexyl)benzenes); polyphenols (e.g. biphenyls, terphenyls, alkylated polyphenols); and alkylated diphenyl ethers and alkylated diphenyl sulfides and the derivatives, analogues and homologues thereof.

Another suitable class of synthetic lubricating oils comprises the esters of dicarboxylic acids (e.g. phthalic acid, succinic acid, alkyl succinic acids and alkenyl succinic acids, maleic acid, azelaic acid, suberic acid, sebasic acid, fumaric acid, adipic acid, linoleic acid dimer, malonic acid, alkylmalonic acids, alkenyl malonic acids) with a variety of alcohols (e.g. butyl alcohol, hexyl alcohol, dodecyl alcohol, 2-ethylhexyl alcohol, ethylene glycol, diethylene glycol monoether, propylene glycol). Specific examples of these esters include dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, and the complex ester formed by reacting one mole of sebacic acid with two moles of tetraethylene glycol and two moles of 2-ethylhexanoic acid.

Esters useful as synthetic oils also include those made from $C_5$ to $C_{12}$ monocarboxylic acids and polyols, and polyol ethers such as neopentyl glycol, trimethylolpropane, pentaerythritol, dipentaerythritol and tripentaerythritol.

Unrefined, refined and re-refined oils can be used in the compositions of the present invention. Unrefined oils are those obtained directly from a natural or synthetic source without further purification treatment. For example, a shale oil obtained directly from retorting operations, a petroleum oil obtained directly from distillation or ester oil obtained directly from an esterification process and used without further treatment would be unrefined oil. Refined oils are similar to the unrefined oils except they have been further treated in one or more purification steps to improve one or more properties. Many such purification techniques, such as distillation, solvent extraction, acid or base extraction, filtration and percolation are known to those skilled in the art. Re-refined oils are obtained by processes similar to those used to obtain refined oils applied to refined oils which have been already used in service. Such re-refined oils are also known as reclaimed or reprocessed oils and often are additional processed by techniques for approval of spent additive and oil breakdown products.

Other examples of base oil are gas-to-liquid ("GTL") base oils, i.e. the base oil may be an oil derived from Fischer-Tropsch synthesised hydrocarbons made from synthesis gas containing $H_2$ and CO using a Fischer-Tropsch catalyst. These hydrocarbons typically require further processing in order to be useful as a base oil. For example, they may, by methods known in the art, be hydroisomerized; hydrocracked and hydroisomerized; dewaxed; or hydroisomerized and dewaxed.

Base oil may be categorised in Groups I to V according to the API EOLCS 1509 definition.

When the oil of lubricating viscosity is used to make a concentrate, it is present in a concentrate-forming amount (e.g., from 30 to 70, such as 40 to 60, mass %) to give a concentrate containing for example 1 to 90, such as 10 to 80, preferably 20 to 80, more preferably 20 to 70, mass % active ingredient of an additive or additives, being component (B) above, or component (B) together with one or more co-additives. The oil of lubricating viscosity used in a concentrate is a suitable oleaginous, typically hydrocarbon, carrier fluid, e.g. mineral lubricating oil, or other suitable solvent. Oils of lubricating viscosity such as described herein, as well as aliphatic, naphthenic, and aromatic hydrocarbons, are examples of suitable carrier fluids for concentrates.

Concentrates constitute a convenient means of handling additives before their use, as well as facilitating solution or dispersion of additives in lubricating oil compositions. When preparing a lubricating oil composition that contains more than one type of additive (sometime referred to as "additive components"), each additive may be incorporated separately, each in the form of a concentrate. In many instances, however, it is convenient to provide a so-called additive "package" (also referred to as an "adpack") comprising one or more co-additives, such as described hereinafter, in a single concentrate.

In the present invention, the oil of lubricating viscosity, provided in a major amount, is in combination with a minor amount of at least one additive and, if necessary, one or more co-additives, such as described hereinafter, constituting a lubricating oil composition. This preparation may be accomplished by adding the additive directly to the oil or by adding it in the form of a concentrate thereof to disperse or dissolve the additive. Additives may be added to the oil by any method known to those skilled in the art, either before, at the same time as, or after addition of other additives.

The terms "oil-soluble" or "oil-dispersible", or cognate terms, used herein do not necessarily indicate that the compounds or additives are soluble, dissolvable, miscible, or are capable of being suspended in the oil in all proportions. These do mean, however, that they are, for example, soluble or stably dispersible in oil to an extent sufficient to exert their intended effect in the environment in which the oil is employed. Moreover, the additional incorporation of other additives may also permit incorporation of higher levels of a particular additive, if desired.

The lubricating oil compositions of the invention may be used to lubricate mechanical engine components, particularly in internal combustion engines, e.g. spark-ignited or compression-ignited two- or four-stoke reciprocating engines, by adding the composition thereto. Preferably, they are crankcase lubricants.

The lubricating oil compositions of the invention (and also concentrates) comprise defined components that may or may not remain the same chemically before and after mixing with an oleaginous carrier. This invention encompasses compositions which comprise the defined components before mixing, or after mixing, or both before and after mixing.

When concentrates are used to make the lubricating oil compositions, they may for example be diluted with 3 to 100, e.g. 5 to 40, parts by mass of oil of lubricating viscosity per part by mass of the concentrate.

Additive Component (B)

This, as stated, is a 4-oxobutanoic acid or salt thereof, carbon atoms number 2 and 3 thereof each being unsubstituted, i.e. they each carry two hydrogen atoms and are part of methylene groups so that the acid contains the $—CO(CH_2)_2COOH$ moiety. Without being bound by any theory, it is believed that the methylene groups in the moiety endow the three O atoms in the moiety with a greater ability to bond to iron on a surface thereby enhancing the friction modification properties of the molecule of which the moiety is a part.

Component (B) may be "ashless" in the sense of being a non-metallic organic material that forms substantially no ash on combustion in contrast to metal-containing and hence ash-forming materials. To confer oil-solubility or oil-dispersibility to the additive component, it carries an appropriate hydrocarbyl group, as in each of (i), (ii) and (iii) as defined herein.

In (i), the 4-oxobutanoic acid (B) is a half acid-half ester. The hydrocarbyl group $R^1$ confers oil-solubility and is straight chain or branched, preferably straight chain, and preferably has from 12 to 20 carbon atoms. It may be alkenyl or alkyl, preferably alkenyl when it preferably has one double bond only. As an example of (i), there may be mentioned $R^1O\ CO\ (CH_2)_2\ COOH$ where the group $R^1$ is $CH_3(CH_2)_7CH{=}CH(CH_2)_8$, i.e. the group $R^1$ is oleyl.

U.S. Pat. No. 4,096,077 ('077) describes lubricating oil compositions that contain at least one half-acid half-ester of succinic acid and an alcohol. '077 describes their use as wear inhibitors but in combination with benzotriazoles, $C_1$-$C_{20}$ alkyl-substituted benzotriazoles, and half-acid half esters of maleic anhydride.

It is preferred that, when the additive component (B) is (i) or (iii), the composition of the invention does not contain either or both of: (a) a half-acid-half-ester of maleic anhydride; and (b) a benzotriazole or C1-C20 alkyl-substituted benzotriazole.

In (ii), (B) is a 4-keto carboxylic acid. The keto group is bonded to an aromatic group such as an aryl or phenyl group which, in turn, is hydrocarbyl-substituted, such as with an alkyl group having from 12 to 20 carbon atoms, in order to confer oil-solubility or oil-dispersibility. Such a keto-compound may conveniently be made by acylating an alkyl-substituted benzene with succinic anhydride.

In (iii), (B) is a half acid-half monoamide, such as obtained by reacting a long chain alkylamine, e.g. where the hydrocarbyl group is an alkyl group and has from 12 to 20 carbon atoms, and succinic acid.

As examples of salts of 4-oxobutanoic acid, there may be mentioned salts formed by reacting the carboxylic acid group with a hydrocarbyl derivative of pyridine, or salts formed by reacting the carboxylic acid group with di-n-butylamine or with tri-n-butylamine.

Co-Additives

As co-additives in the compositions of the invention, there may be mentioned other organic friction modifiers, different from (B), such as those having a polar head group that contains an oxygen atom or a nitrogen atom or both. They may be referred to as organic ashless (metal-free) friction modifiers and may be ester-based, such as glycerol mono-oleate, or amine-based (aminic). Also, there may be mentioned inorganic friction modifiers, i.e., metal-containing friction modifiers. Organo-molybdenum compounds, such as dinuclear or trinuclear molybdenum compounds, are preferred where an inorganic friction modifier is to be provided, and may be present at a concentration in the range 0.1 to 2 mass %, or providing at least 10 such as 50 to 2,000 ppm by mass of molybdenum atoms.

Preferably, the molybdenum from the molybdenum compound is present in an amount of from 10 to 1500, such as 20 to 1000, more preferably 30 to 750, ppm based on the total weight of the lubricating oil composition. For some applications, the molybdenum is present in an amount of greater than 500 ppm.

Other co-additives, with representative effective amounts are listed below. All the values listed are stated as mass percent active ingredient.

| Additive | Mass % (Broad) | Mass % (Preferred) |
|---|---|---|
| Ashless Dispersant | 0.1-20 | 1-8 |
| Metal Detergents | 0.1-15 | 0.2-9 |
| Corrosion Inhibitor | 0-5 | 0-1.5 |
| Metal Dihydrocarbyl Dithiophosphate | 0-10 | 0-4 |
| Anti-Oxidants | 0-5 | 0.01-3 |
| Pour Point Depressant | 0.01-5 | 0.01-1.5 |
| Anti-Foaming Agent | 0-5 | 0.001-0.15 |
| Supplement Anti-Wear Agents | 0-5 | 0-2 |
| Viscosity Modifier (1) | 0-6 | 0.01-4 |
| Mineral or Synthetic Base Oil | Balance | Balance |

(1) Viscosity modifiers are used only in multi-graded oils.

The final lubricating oil composition, typically made by blending the or each additive into the base oil, may contain from 5 to 25, preferably 5 to 18, typically 7 to 15 mass % of the concentrate, the remainder being oil of lubricating viscosity.

The above mentioned co-additives are discussed in farther detail as follows, as is known in the art, some additives can provide a multiplicity of effects, for example, a single additive may act as a dispersant and as an oxidation inhibitor.

A dispersant is an additive whose primary function is to hold solid and liquid contaminations in suspension, thereby passivating them and reducing engine deposits at the same time as reducing sludge depositions. For example, a dispersant maintains in suspension oil-insoluble substances that result from oxidation during use of the lubricant, thus preventing sludge flocculation and precipitation or deposition on metal parts of the engine.

Dispersants are usually "ashless", as mentioned above, being non-metallic organic materials that form substantially no ash on combustion, in contrast to metal-containing, and hence ash-forming materials. They comprise a long hydrocarbon chain with a polar head, the polarity being derived from inclusion of e.g. an O, P, or N atom. The hydrocarbon is an oleophilic group that confers oil-solubility, having, for example 40 to 500 carbon atoms. Thus, ashless dispersants may comprise an oil-soluble polymeric backbone.

A preferred class of olefin polymers is polybutenes, specifically polyisobutenes (PIB) or poly-n-butenes, such as may be prepared by polymerization of a $C_4$ refinery stream.

Dispersants include, for example, derivatives of long chain hydrocarbon-substituted carboxylic acids, examples being derivatives of high molecular weight hydrocarbyl-substituted succinic acid. A noteworthy group of dispersants are hydrocarbon-substituted succinimides, made, for example, by reacting the above acids (or derivatives) with a nitrogen-containing compound, advantageously by a polyalkylene polyamine, such as a polyethylene polyamine. Particularly preferred are the reaction products of polyalkylene polyamines with alkenyl succinic anhydrides, such as described in U.S. Pat. Nos. 3,202,678; 3,154,560; 3,172,892; 3,024,195; 3,024,237, 3,219,666; and 3,216,936; and BE-A-66,875 that may be post-treated to improve their properties, such as borated (as described in U.S. Pat. Nos. 3,087,936 and 3,254,025) fluorinated and oxylated. For example, boration may be accomplished by treating an acyl nitrogen-containing dispersant with a boron compound selected from boron oxide, boron halides, boron acids and esters of boron acids.

A detergent is an additive that reduces formation of piston deposits, for example high-temperature varnish and lacquer deposits, in engines; it normally has acid-neutralising properties and is capable of keeping finely divided solids in suspension. Most detergents are based on metal "soaps", that is metal salts of acidic organic compounds.

Detergents generally comprise a polar head with a long hydrophobic tail, the polar head comprising a metal salt of an acidic organic compound. The salts may contain a substantially stoichiometric amount of the metal when they are usually described as normal or neutral salts and would typically have a total base number or TBN (as may be measured by ASTM D2896) of from 0 to 80. Large amounts of a metal base can be included by reacting an excess of a metal compound, such as an oxide or hydroxide, with an acidic gas such as carbon dioxide. The resulting overbased detergent comprises neutralised detergent as an outer layer of a metal base (e.g. carbonate) micelle. Such overbased detergents may have a TBN of 150 or greater, and typically of from 250 to 500 or more.

Detergents that may be used include oil-soluble neutral and overbased sulfonates, phenates, sulfurized phenates, thiophosphonates, salicylates, and naphthenates and other oil-soluble carboxylates of a metal, particularly the alkali or alkaline earth metals, e.g. sodium, potassium, lithium, calcium and magnesium. The most commonly used metals are calcium and magnesium, which may both be present in detergents used in a lubricant, and mixtures of calcium and/or magnesium with sodium. Particularly convenient metal detergents are neutral and overbased calcium sulfonates and sulfurized phenates having a TBN of from 50 to 450.

Anti-oxidants are sometimes referred to as oxidation inhibitors; they increase the resistance of the composition to oxidation and may work by combining with and modifying peroxides to render them harmless, by decomposing peroxides, or by rendering an oxidation catalyst inert. Oxidative deterioration can be evidenced by sludge in the lubricant, varnish-like deposits on the metal surfaces, and by viscosity growth.

They may be classified as radical scavengers (e.g. sterically hindered phenols, secondary aromatic amines, and organo-copper salts); hydroperoxide decomposers (e.g., organosulphur and organophosphorus additives); and multifunctionals (e.g. zinc dihydrocarbyl dithiophosphates, which may also function as anti-wear additives, and organo-molybdenum compounds, which may also function as friction modifiers and anti-wear additives).

Examples of suitable antioxidants are selected from copper-containing antioxidants, sulphur-containing antioxidants, aromatic amine-containing antioxidants, hindered phenolic antioxidants, dithiophosphates derivatives, metal thiocarbamates, and molybdenum-containing compounds.

Dihydrocarbyl dithiophosphate metals salts are frequently used as antiwear and antioxidant agents. The metal may be an alkali or alkaline earth metal, or aluminium, lead, tin, zinc molybdenum, manganese, nickel or copper. Zinc salts are most commonly used in lubricating oil such as in amounts of 0.1 to 10, preferably 0.2 to 2, mass % based upon the total mass of the lubricating oil compositions. They may be prepared in accordance with known techniques by first forming a dihydrocarbyl dithiophosphoric acid (DDPA), usually by reaction of one or more alcohols or a phenol with $P_2S_5$, and then neutralising the formed DDPA with a zinc compound. For example, a dithiophosphoric acid may be made by reaction with mixtures of primary and secondary alcohols. Alternatively, multiple dithiophosphoric acids can be prepared where the hydrocarbyl groups on one acid are entirely secondary in character and the hydrocarbyl groups on the other acids are entirely primary in character. To make the zinc salt, any basic or neutral zinc compound could be used but the oxides, hydroxides and carbonates are most generally employed. Commercial additives frequently contain an excess of zinc due to use of an excess of the basic zinc compound in the neutralisation reaction.

Anti-wear agents reduce friction and excessive wear and are usually based on compounds containing sulphur or phosphorous or both, for example that are capable of depositing polysulfide films on the surfaces involved. Noteworthy are the dihydrocarbyl dithiophosphates, such as the zinc dialkyl dithiophosphates (ZDDP's) discussed herein.

Examples of ashless anti-wear agents include 1,2,3-triazoles, benzotriazoles, thiadiazoles, sulfurised fatty acid esters, and dithiocarbamate derivatives.

Rust and corrosion inhibitors serve to protect surfaces against rust and/or corrosion. As rust inhibitors there may be mentioned non-ionic polyoxyalkylene polyols and esters thereof, polyoxyalkylene phenols, and anionic alkyl sulfonic acids.

Pour point depressants, otherwise known as lube oil flow improvers, lower the minimum temperature at which the oil will flow or can be poured. Such additives are well known. Typical of these additive are $C_8$ to $C_{18}$ dialkyl fumerate/vinyl acetate copolymers and polyalkylmethacrylates.

Additives of the polysiloxane type, for example silicone oil or polydimethyl siloxane, can provide foam control.

A small amount of a demulsifying component may be used. A preferred demulsifying component is described in EP-A-330,522. It is obtained by reacting an alkylene oxide with an adduct obtained by reacting a bis-epoxide with a polyhydric alcohol. The demulsifier should be used at a level not exceeding 0.1 mass % active ingredient. A treat rate of 0.001 to 0.05 mass % active ingredient is convenient.

Viscosity modifiers (or viscosity index improvers) impart high and low temperature operability to a lubricating oil. Viscosity modifiers that also function as dispersants are also known and may be prepared as described above or ashless dispersants. In general, these dispersant viscosity modifiers are functionalised polymers (e.g. interpolymers of ethylene-propylene post grafted with an active monomer such as maleic anhydride) which are then derivatised with, for example, an alcohol or amine.

The lubricant may be formulated with or without a conventional viscosity modifier and with or without a dispersant viscosity modifier. Suitable compounds for use as viscosity modifiers are generally high molecular weight hydrocarbon polymers, including polyesters. Oil-soluble viscosity modifying polymers generally have weight average molecular weights of from 10,000 to 1,000,000, preferably 20,000 to 500,000, which may be determined by gel permeation chromatography or by light scattering.

EXAMPLES

The invention will now be particularly described in the following examples which are not intended to limit the scope of the claims hereof.

In the examples, the following additive components were used in examples of the invention:

B1: a 4-oxobutanoic acid in the form of 4-stearyl benzoyl propanoic acid (SBP); and B2: a 4-oxobutanoic acid in the form of mono-oleyl succinate (MOS); and a glycerol mono-oleate friction modifier (GMO), known in the art, used in a reference example.

Component B1 was synthesised by acylation of stearylbenzene with succinic anhydride according to a literature procedure (P. Nuhn et al; Pharmazie 53, 12, 825, 1998). Thus, aluminium trichloride was added to a mixture of stearylbenzene and succinic anhydride in nitrobenzene at 5° C. After standing overnight the mixture was poured over ice and washed with water. Evaporation of the solvent from the organic layer gave the product (SBP) in good purity. A total of 230 grams of product was prepared in three batches.

Component B2 was prepared by reacting 0.5 moles of succinic anhydride with 0.5 moles of oleyl alcohol. The reactants were mixed under a nitrogen blanket with an overhead stirrer in a 500 ml flask fitted with a condenser for six hours at 120° C. The resultant mono-oleyl succinate was used without further purification.

Using the same base oil, each of the above additive components was blended into compositions to provide examples of the invention and a reference example. The contents of the compositions are set forth below under the heading "Testing and Results".

Testing and Results

A high frequency reciprocating rig (HFRR) was used to evaluate the coefficient of friction of each of the above compositions. Examples of the invention are identified as Examples 1 and 2, and corresponding reference examples as Examples 1' and 2'.

Experiment 1

The HFRR test protocol employed was as follows:

| | |
|---|---|
| Contact | 6 mm ball on 10 mm disc |
| Load, N | 4 |
| Stroke Length, mm | 1 |
| Frequency, Hz | 20 |
| Temperature, ° C. | 100 |
| Time of reciprocation, s | 3600 |

The results obtained were as follows:

| Example | Additive | Coefficient of Friction |
|---|---|---|
| 1 | B1 (SBP) | 0.092 |
| 1' | GMO | 0.123 |

In this experiment, each oil composition contained 0.2 mass % of active ingredient of the additive in the above table. The compositions were identical other than in respect of the identity of the additive shown in the table above.

The coefficient of friction measurements were average values taken after 60 minutes at 100° C.

Experiment 2

The HFRR test protocol employed was as follows:

| | |
|---|---|
| Contact | 6 mm ball on 10 mm disc |
| Load, N | 4 |
| Stroke Length, mm | 1 |
| Frequency, Hz | 20 |
| Temperature range, ° C. | 40-140 |
| Temperature step, ° C. | 20 |
| Time of reciprocation at each temperature, s | 300 |

The results obtained were as follows:

| | | Coefficient of Friction | | | | | |
|---|---|---|---|---|---|---|---|
| Example | Additive | 40° C. | 60° C. | 80° C. | 100° C. | 120° C. | 140° C. |
| 2 | B2 (MOS) | 0.101 | 0.106 | 0.120 | 0.111 | 0.099 | 0.091 |
| 2' | GMO | 0.153 | 0.162 | 0.150 | 0.148 | 0.119 | 0.116 |

In this experiment, each oil composition contained 0.2 mass % of active ingredient of the additive in the table above. The compositions were identical other than in respect of the identity of the additive shown in the table above.

The coefficient of friction measurements were average values taken after 30 minutes at each of the indicated temperatures.

The above results show that the compositions of the invention (Examples 1 and 2) gave rise to better (i.e. smaller) coefficient of friction values in all cases than the corresponding reference compositions (Examples 1' and 2').

What is claimed is:

1. An automotive lubricating oil composition comprising or made by admixing:

(A) an oil of lubricating viscosity in a major amount; and (B) as an oil-soluble or oil-dispersible additive component in a minor amount, a 4-oxobutanoic acid having the moiety —$CO(CH_2)_2COOH$ bonded to (i) a group $OR^1$, wherein $R^1$ is a hydrocarbyl group having from 10 to 30 carbon atoms, to provide a half-acid half-ester; or (ii) a group X, wherein X is an aromatic group substituted with at least one hydrocarbyl group having from 10 to 30 carbon atoms to provide a keto-acid; or (iii) a group $NR^2R^3$ wherein one or both of $R^2$ and $R^3$ is a hydrocarbyl group having from 10 to 30 carbon atoms and one but not both of $R^2$ and $R^3$ may be a hydrogen atom, to provide a half-acid half-amide, or a salt thereof.

2. The composition as claimed in claim 1, wherein the groups $R^1$, $R^2$ and $R^3$ and the hydrocarbyl group in X each have from 12 to 20 carbon atoms.

3. A composition as claimed in claim 1, wherein the 4-oxobutanoic acid has formula $R^1OCO(CH_2)_2COOH$ where the group $R^1$ is an alkenyl group.

4. A composition as claimed in claim 2, wherein the 4-oxobutanoic acid has formula $R^1OCO(CH_2)_2COOH$ where the group $R^1$ is an alkenyl group.

5. A composition as claimed in claim 3, wherein, when the 4-oxobutanoic acid has the formula $R^1OCO(CH_2)_2COOH$ or the formula $R^2R^3NCO(CH_2)_2COOH$, the composition does not contain either or both of: (a) a half acid-half ester of maleic anhydride; and (b) a benzotriazole or C1-C20 alky-substituted benzotriazole.

6. A composition as claimed in claim 4, wherein, when the 4-oxobutanoic acid has the formula $R^1OCO(CH_2)_2COOH$ or the formula $R^2R^3NCO(CH_2)_2COOH$, the composition does not contain either or both of: (a) a half acid-half ester of maleic anhydride; and (b) a benzotriazole or C1-C20 alky-substituted benzotriazole.

7. A composition as claimed in claim 1, wherein the 4-oxobutanoic acid has the formula X $CO(CH_2)_2COOH$ where X is a stearyl-substituted phenyl group.

8. A composition as claimed in claim 2, wherein the 4-oxobutanoic acid has the formula X $CO(CH_2)_2COOH$ where X is a stearyl-substituted phenyl group.

9. A composition as claimed in claim 1, wherein additive component (B) is metal-free.

10. A composition as claimed in claim 1, further comprising one or more co-additives, different from (B), selected from ashless dispersants, metal detergents, corrosion inhibitors, metal dihydrocarbyl dithiophosphates, antioxidants, pour point dispersants, friction modifiers, antifoam agents and viscosity modifiers.

11. A method of lubricating an internal combustion engine comprising (a) supplying the crankcase thereof with a composition as claimed in claim 1, and (b) operating the engine.

12. A composition as claimed in claim 4, wherein the group $R^1$ is $CH_3(CH_2)_7CH{=}CH(CH_2)_8$.

13. A composition as claimed in claim 5, wherein the group $R^1$ is $CH_3(CH_2)_7CH{=}CH(CH_2)_8$.

* * * * *